US007419079B2

(12) United States Patent
Chen et al.

(10) Patent No.: US 7,419,079 B2
(45) Date of Patent: Sep. 2, 2008

(54) PNEUMATIC TOOL

(75) Inventors: Jack Chen, Taichung (TW); Jim Wang, Taichung (TW)

(73) Assignee: Basso Industry Corp., Taichung (TW)

( * ) Notice: Subject to any disclaimer, the term of this patent is extended or adjusted under 35 U.S.C. 154(b) by 96 days.

(21) Appl. No.: 11/346,139

(22) Filed: Feb. 3, 2006

(65) Prior Publication Data

US 2007/0181629 A1 Aug. 9, 2007

(51) Int. Cl.
*B25C 1/04* (2006.01)

(52) U.S. Cl. ..... 227/130; 227/136

(58) Field of Classification Search ..... 227/18, 227/136, 135, 130

See application file for complete search history.

(56) References Cited

U.S. PATENT DOCUMENTS 942,163 A * 12/1909 Berner ..... 60/370
5,259,826 A * 11/1993 Woods ..... 493/325
5,944,119 A * 8/1999 Hsieh ..... 173/170
6,508,392 B1 * 1/2003 Huang ..... 227/18

* cited by examiner

*Primary Examiner*—Brian D. Nash
*Assistant Examiner*—Nathaniel Chukwurah
(74) *Attorney, Agent, or Firm*—Egbert Law Offices

(57) ABSTRACT

The pneumatic tool has a check valve placed inside that includes an internal and external valve base and traveling valve. The internal valve base has an inlet hole, and an enlarged slot is formed on the external end of the inlet hole. An annular oblique edge is formed between the enlarged slot and inlet hole, and an air hole is placed on the enlarged slot. The external valve base has an outlet hole that is connected to the outside of the pneumatic tool. A protruding tube is formed inside the outlet hole. Interval space is formed between the inside of the protruding tube and the inlet hole for the internal valve base; and the traveling valve can be traveling inside the interval space. The built-in check valve can avoid external force, which extends the shelf life and makes appearance of the product look neater and practical.

5 Claims, 7 Drawing Sheets

PNEUMATIC TOOL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pneumatic tool, and more particularly to a device that has a check valve for an air inlet and outlet between the first and second cylinder.

BACKGROUND OF THE INVENTION

The conventional pneumatic nail gun uses a single cylinder and piston to accomplish the nailing function.

Some nail guns have other functions besides a nailing function, such as sending the pad to the nail outlet when nailing so that there is an extra padding effect after the nail is sent. These nail guns satisfy multiple needs of the users, and there is a typical embodiment. So as to implement these multiple functions, the industry usually adds a second cylinder and piston on one side of the original cylinder (hereafter referred to as first cylinder) to drive the component of the other function mentioned above. Moreover, it creates the air channel between the second cylinder and the first cylinder so that the piston inside the second cylinder can create displacement while the first cylinder is nailing.

Among them, the conventional check valve that is placed between the second cylinder and the first cylinder is shown in FIG. 1. The check valve 03 is placed on the outside of the second cylinder 02, and the check valve 03 is connected to the first cylinder 01 by a pipe 04. Except, it is found that the conventional structure is easily broken due to the external force of using the check valve 01 and its pipe 04, which shortens the shelf life. In terms of the product, it affects the entire look and unity, which is a subject that needs to be improved further.

Thus, to overcome the aforementioned problems of the prior art, it would be an advancement in the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

The present invention uses the unique built-in check valve, with regard to the conventional external style mentioned previously, to achieve the features of the pneumatic tool. The invention avoids the external force so as to extend the life the product and makes the appearance of the product show unity.

In addition, the present invention uses structures, such as the internal and external valve base 30 40 and traveling valve 50 of built-in check valve B, so that the internal and external tapered protruding end 51 52 for the traveling valve 50 can induce and block the air as expected, making simpler manufacturing, convenient assembly and stable movement.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
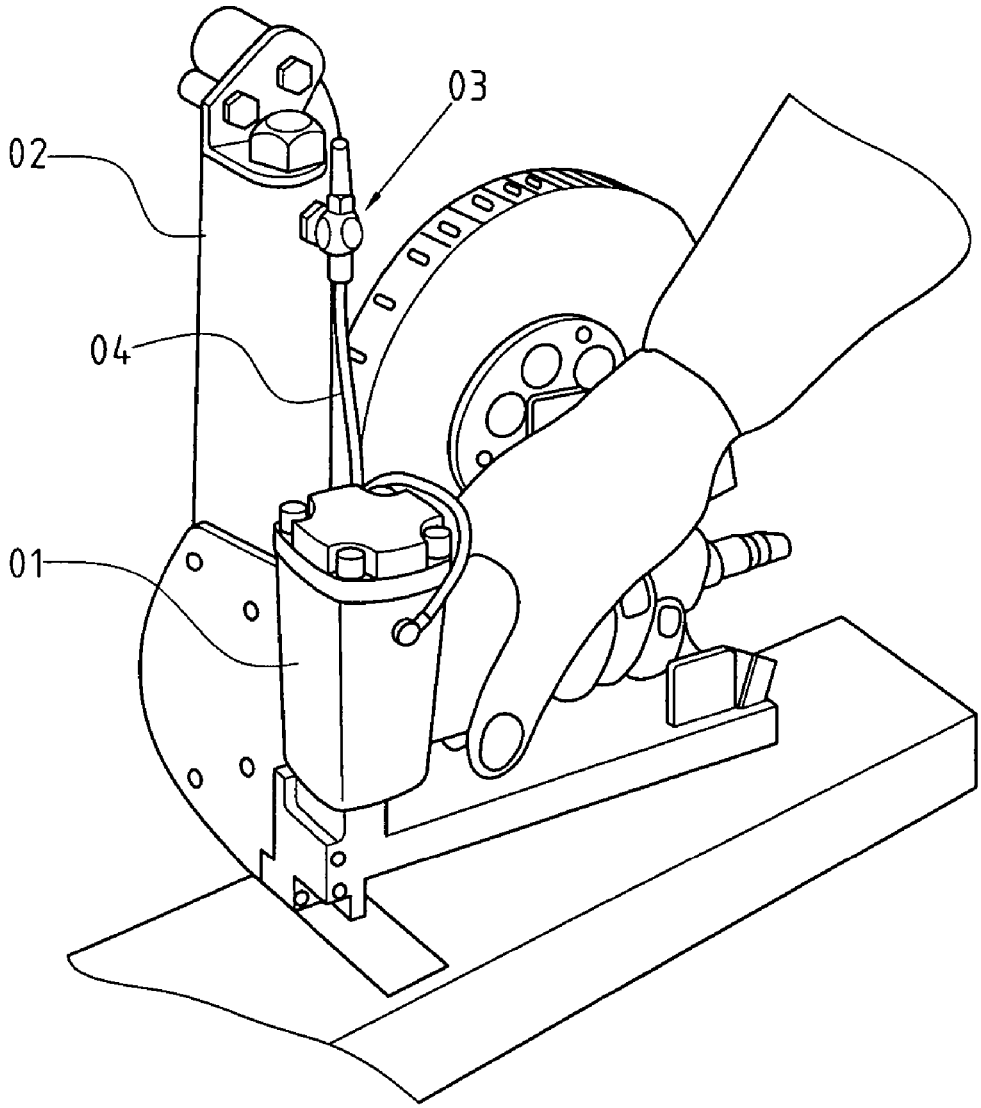
FIG.1 PRIOR ART
FIG. 1 shows a perspective view of the conventional structure.
Figure 2:
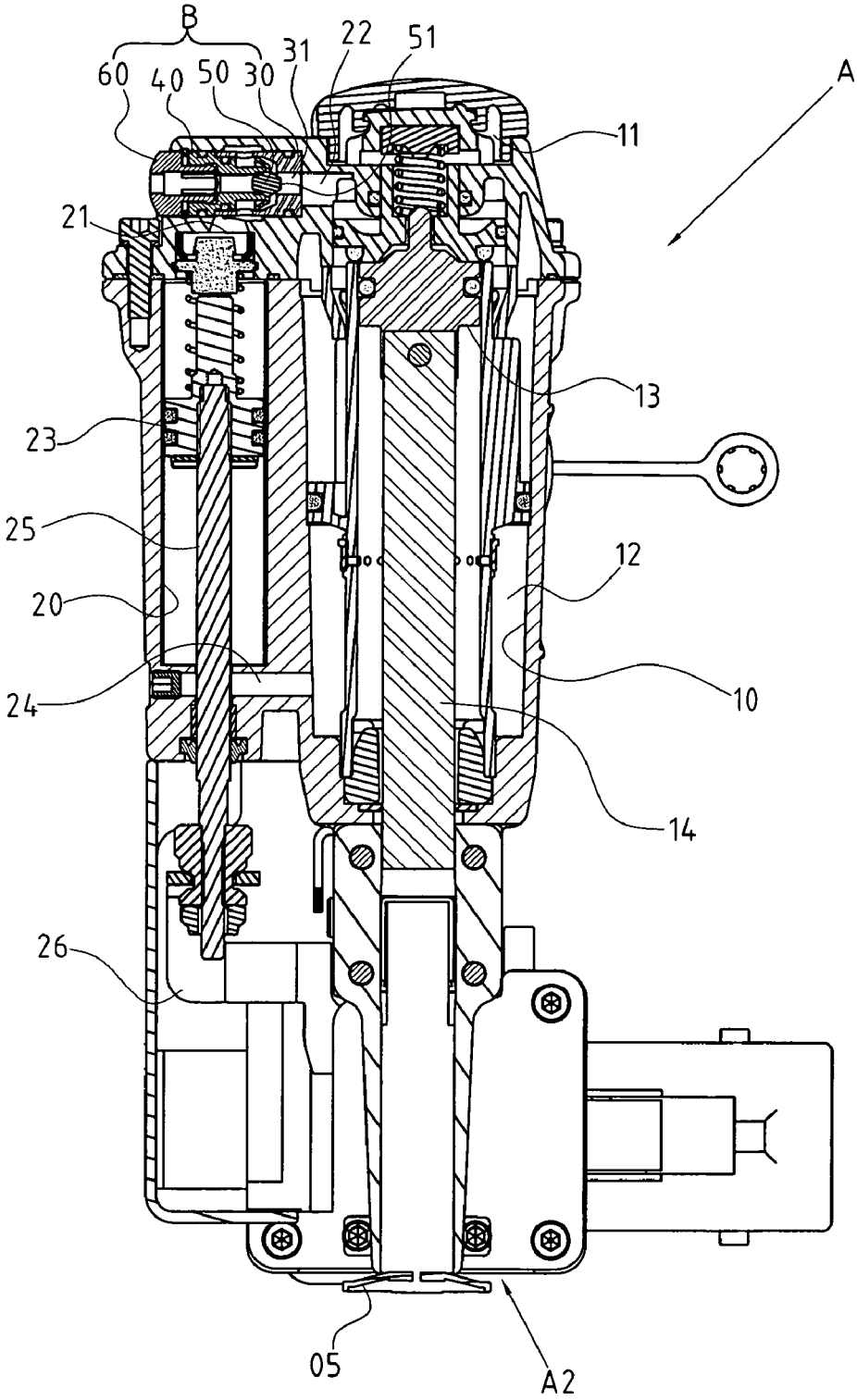
FIG. 2 shows a sectional view of the preferred embodiment of the present invention.
Figure 3:
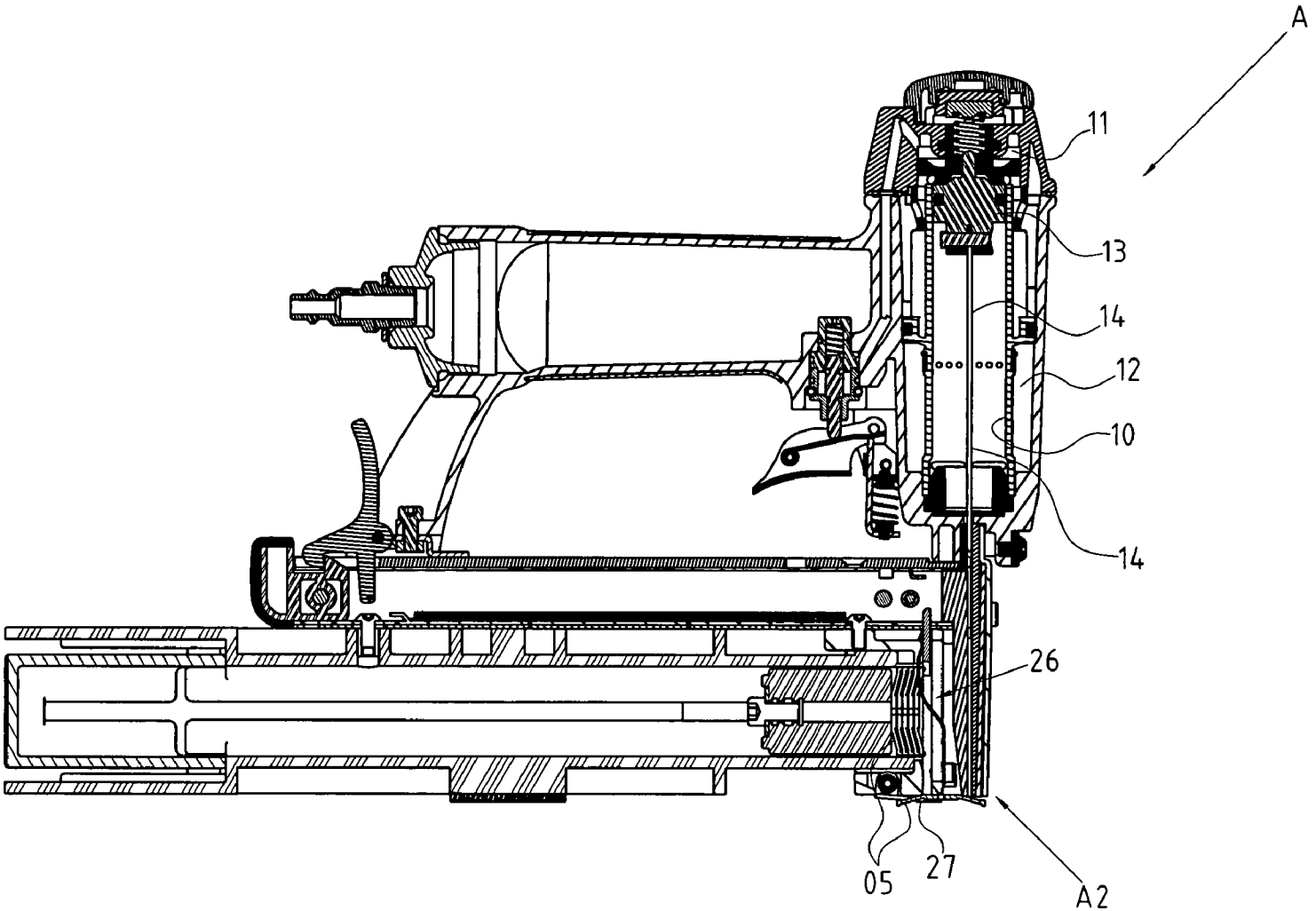
FIG. 3 shows another sectional view of the preferred embodiment of the present invention.
Figure 4:
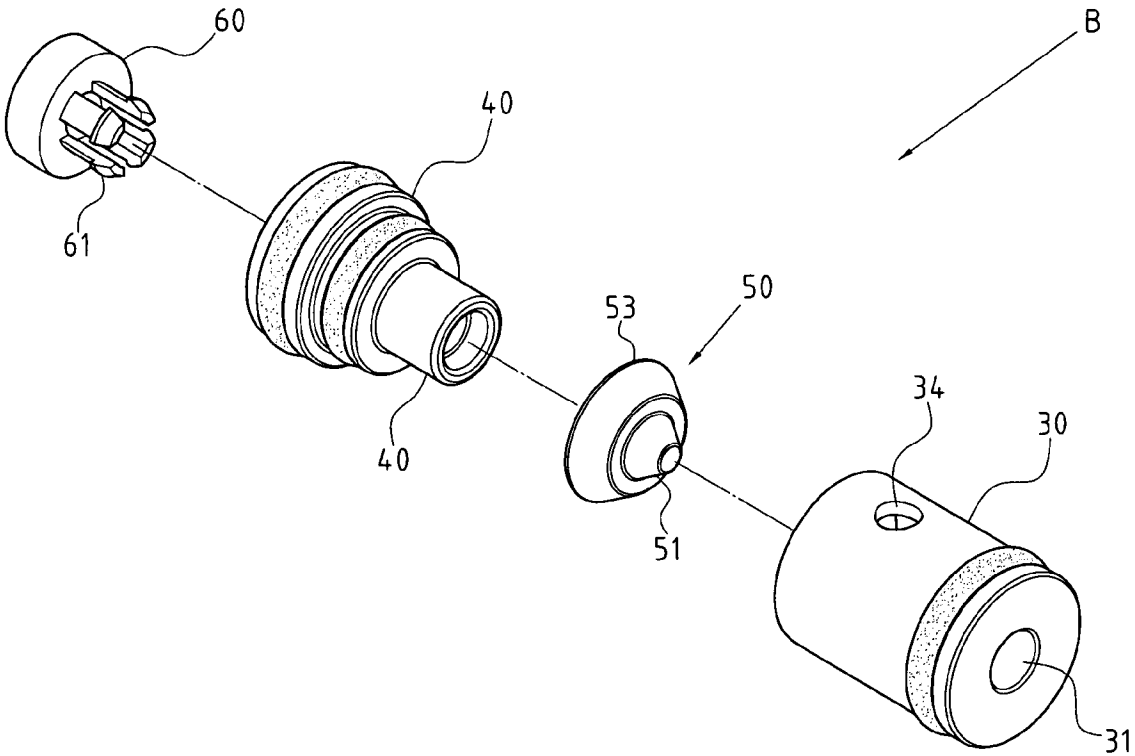
FIG. 4 shows an exploded perspective view of the built-in check valve of the preferred embodiment.

As shown in FIGS. 2-4, there is a preferred embodiment of the pneumatic tool A, a nailer.

A first cylinder 10 is placed inside the pneumatic tool A, and the first cylinder 10 includes an air inlet 11 and a lower air chamber 12 (the present embodiment is the through hole style that is placed on the wall of the first cylinder). A first piston 13 is placed inside the first cylinder 10, and in the present embodiment, the first piston 13 drives the striker pin 14 to make the expected nailing movement.

A second cylinder 20 is a supply cylinder, and it is placed on the first cylinder 10 inside the pneumatic tool A and spaced from the first cylinder. The air inlet 21 of the second cylinder 20 is connected to the air inlet 11 for the first side channel 22 and the first cylinder 10. A second piston 23 is placed inside the second cylinder 20, and at the bottom of the second piston 23, the second cylinder 20 in connected to the lower chamber 12 of the first cylinder 10 by a second side channel 24. The second piston 23 drives a transmission shaft 25, which is operated downward to drive a shelf 26, as shown in the present embodiment. The movement of the shelf can control the disc 05 in the direction of the nail outlet A2, and when the disc 05 moves to the nail outlet A2 of the pneumatic tool A, it uses an elastic plate 27 to press to position, so when the nail is stroked, the disc 05 is stroke out at the same time.

A built-in check valve B is placed on the first side channel 22 between the air inlets 11 21 of the first and second cylinder 10 20 inside the pneumatic tool A. By so doing, the inlet and outlet paths of the second cylinder 20 and controlled.

The built-in check valve B includes an internal valve base 30, which has an inlet hole 31 that is connected to the first side channel 22. The outer end of the inlet hole 31 forms an enlarged slot 32, and an annular oblique edge 33 is formed between the enlarged slot and the inlet hole 31. The enlarged slot 32 has an air hole 34 that is connected to the second cylinder 20.

The built-in check valve B also includes an external valve base 40, which has an outlet hole 41 that is connected to the external side of the pneumatic tool A. A protruding tube 42 inside the outlet hole 41 extends to the enlarged slot 32 of the internal valve base 30, and an interval space 43 is placed between the protruding tube 42 and the inlet hole 31 on the internal valve base 30.

A traveling valve 50 is traveling inside the interval space 43 mentioned above, and the traveling valve 50 includes internal and external tapered protruding ends 51 52, and a tapered loop edge 53. The internal tapered protruding end 51 corresponds to the inlet hole 31 of the internal valve base 30, and the external tapered protruding end 52 corresponds to the protruding tube 42 of the external valve base 40. The tapered loop edge 53 corresponds to the annular oblique edge 33 of the internal valve base 30.

Among them, an outlet nozzle 50 is placed on the external end of the external valve base 40, and a claw 61 is placed on the internal end of the outlet nozzle, so that a groove 44 placed on the external end of the external valve base 40 can be locked in with the claw 61, positioning the outlet nozzle 50 and the external valve base 40.

Through the above structure, the operation of the present invention is disclosed and explained herein.

Figure 5:
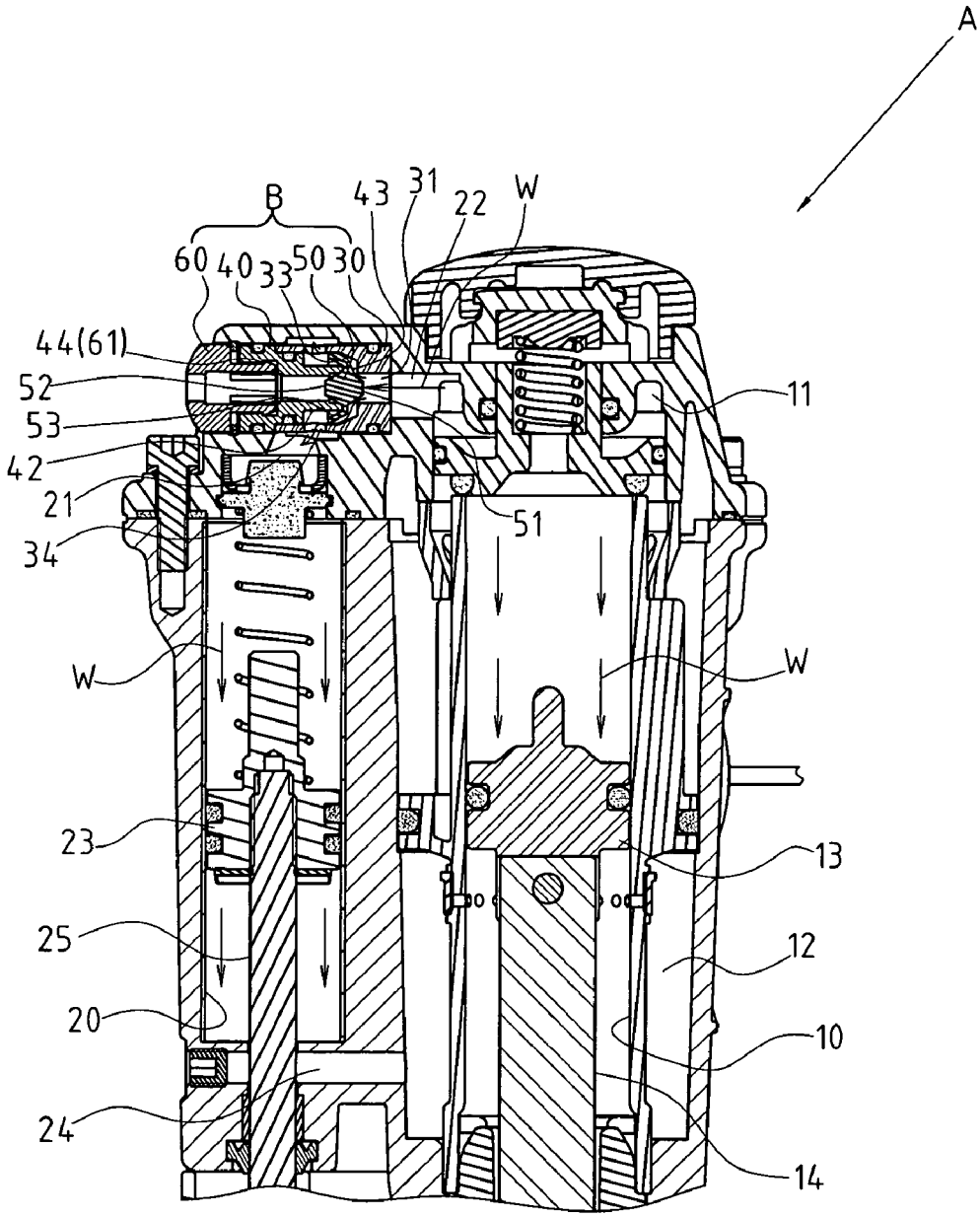
FIG. 5 shows a sectional view of the operation of the present invention.
Figure 6:
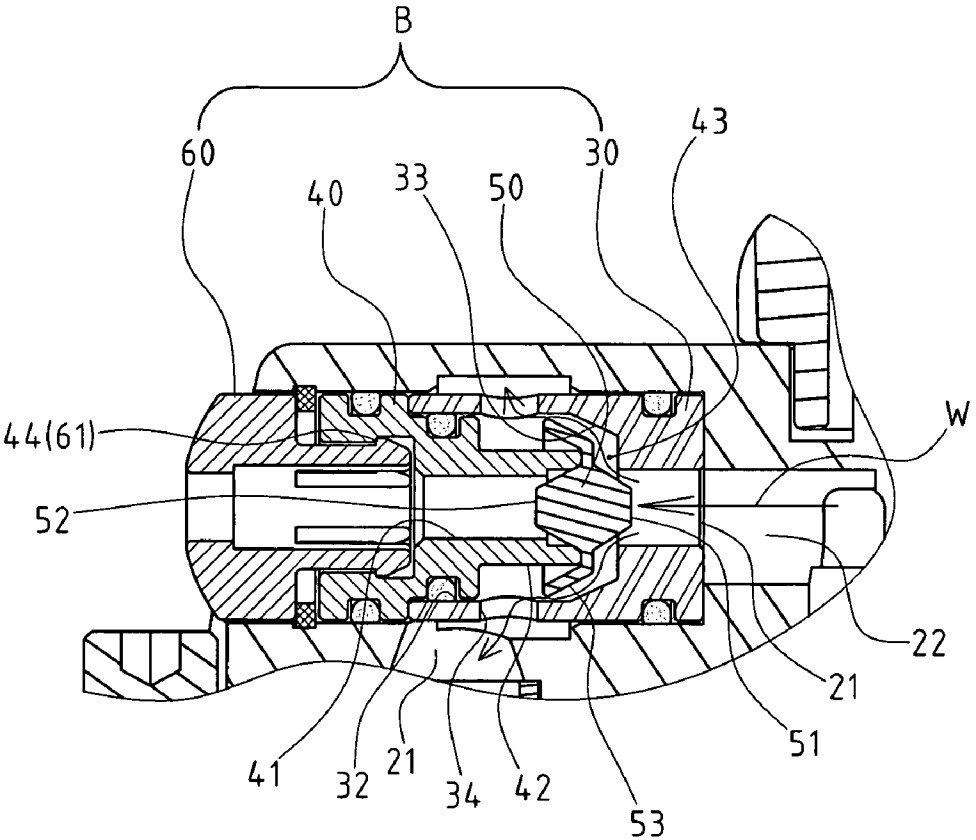
FIG. 6 shows an enlarged sectional view of the built-in check valve in FIG. 5.

As shown in FIGS. 5 and 6, when the pneumatic tool A is connected to the air sources and induces the air pressure W, the air pressure W comes from the air inlet 11 to the first cylinder 10 flows to the second cylinder 20 through the first side channel 22. During this process, the air pressure W pushes the traveling valve 50 of the built-in check valve B against the protruding tube 42 of the external valve base 40. Thus, the air pressure W may flow to the air hole 34 for the enlarged slot 32 through the opening between the tapered loop edge 53 and the annular oblique edge 33, and further into the second cylinder 20. Eventually the purpose of driving the second piston 23 is achieved, and the disc 05 is pushed. At this time, the built-in check valve B blocks the protruding tube 42 to stop the outlet hole 41 of the external valve base 40 to keep the air from going out. When the trigger is pulled, the first piston 13 of the first cylinder 10 generates the nailing movement.

Figure 7:
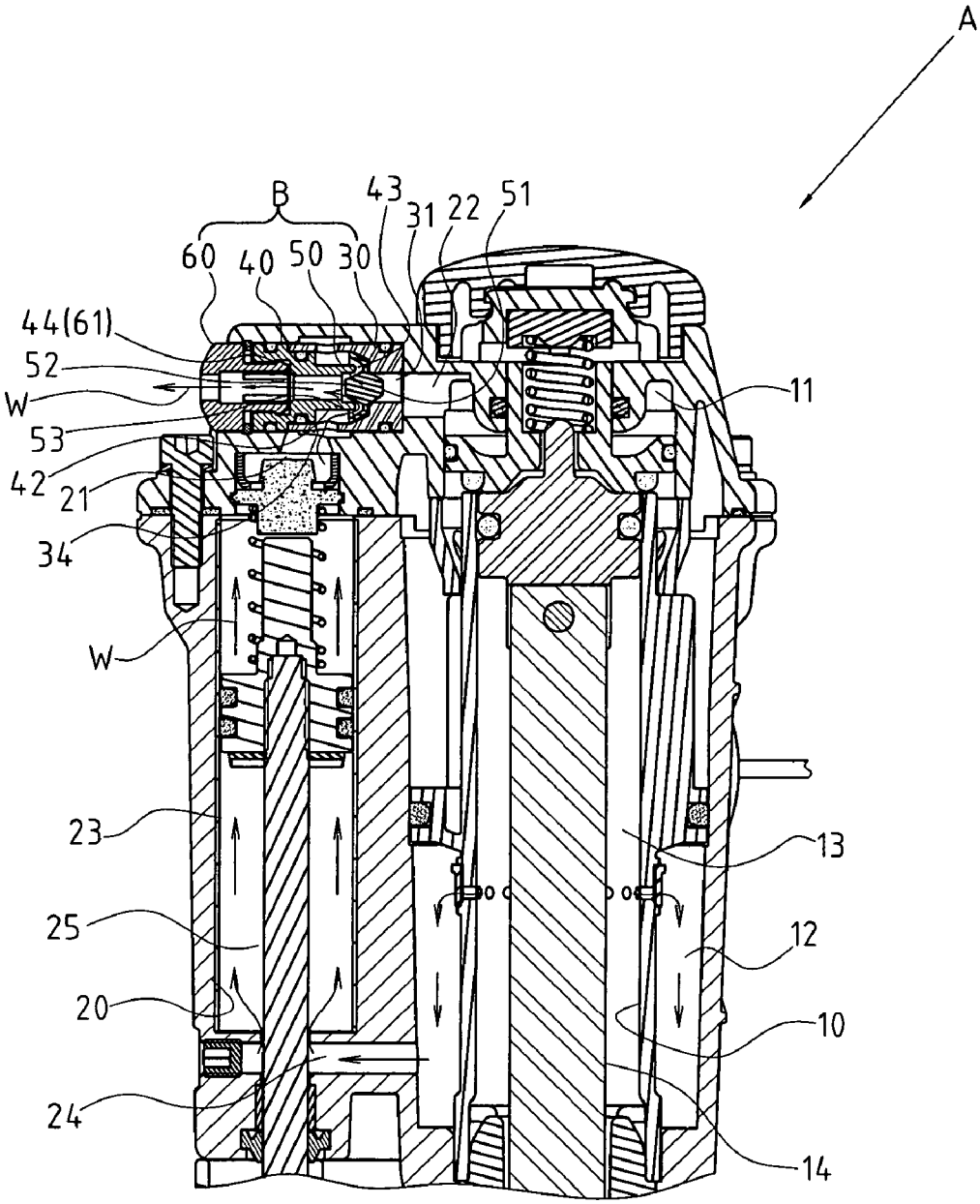
FIG. 7 shows a sectional view of the operation of the present invention.

As shown in FIG. 7, when the nail gun completes the nailing movement, and after the first piston 13 of the first cylinder 10 complete one stroke, the air inlet 11 of the first cylinder 10 loses air pressure. The air pressure in the lower air chamber at the bottom of the first cylinder 10 increases and pushes the first piston 13 up. During this process, the air pressure W flows toward the second cylinder 20 through the second side channel 24 back to the second piston 23. When the air pressure W on top of the second piston pushes up and enters the built-in check valve B through the air hole 34, it may push the traveling valve 50 toward internal valve base 30, and it may block the inlet hole 31 through the internal tapered protruding end 51 to stop the path. The external tapered end 52 separates from the protruding tube 42, and the opening is made. For this reason, the air pressure W may be removed through the outlet hole 41 of the external valve base 40.

We claim:

1. A pneumatic tool comprising:

a first cylinder having a first air inlet;

a second cylinder having a second air inlet, said second air inlet also being an outlet so as to pass air in and out of said second cylinder;

a first side channel connecting said first air inlet and said second air inlet; and an air inlet and outlet check valve placed on said first side channel so as to control air in and out of said second cylinder, said first side channel being in fluid connection with said second cylinder through said air inlet and outlet check valve, said air inlet and outlet check valve having an built-in check valve, said built-in check valve comprising:

an internal valve base having an air inlet hole connected to a side channel thereof;

an external valve base having an outlet hole connected to an external side thereof; and a traveling valve positioned so as to travel in an interval space between said internal valve base and said external valve base, wherein said internal valve base has an enlarged slot formed on an outside of said inlet hole thereof, said internal valve base having an annular oblique edge formed between said enlarged slot and said inlet hole thereof, said enlarged slot having an air hole connected to said second cylinder, said external valve base having a protruding tube formed inside said outlet hole thereof, said protruding tube extending to said enlarged slot of said internal valve base, said interval space defined by an opening between an inside of said protruding tube and said inlet hole of said internal valve base, said traveling valve having an internal tapered protruding end and an external tapered protruding end and a tapered loop edge, said internal tapered protruding end corresponding to said inlet hole of said internal valve base, said external protruding end corresponding to said protruding tube of said external valve base, said tapered loop edge corresponding to said annular oblique edge of said internal valve base.

2. The pneumatic tool of claim 1, further comprising:

an outlet nozzle placed on an external end of said external valve base.

3. A pneumatic tool comprising:

a first cylinder having a first air inlet;

a second cylinder having a second air inlet, said second air inlet also being an outlet so as to pass air in and out of said second cylinder;

a first side channel connecting said first air inlet and said second air inlet; and an air inlet and outlet check valve placed on said first side channel so as to control air in and out of said second cylinder, said first side channel being in fluid connection with said second cylinder through said air inlet and outlet check valve, said air inlet and outlet check valve being comprised of a built-in check valve, said built-in check valve comprising:

an internal valve base having an inlet hole connected to a side channel thereof, said inlet hole having an outer end defining an enlarged slot, said internal valve base having an oblique edge formed between said enlarged slot and said inlet hole, said enlarged slot having an air hole connected to said second cylinder;

an external valve base having an outlet hole connected to an external side thereof, said external valve base having a protruding tube inside said outlet hole and extending to said enlarged slot of said internal valve base, an interval space being positioned between said protruding tube and said inlet hole on said internal valve base, and a traveling valve having an internal tapered protruding end and an external tapered protruding end, said traveling valve traveling inside said interval space, said traveling valve having a tapered loop edge, said internal tapered protruding end corresponding to said inlet hole of said internal valve base, said external tapered protruding end corresponding to said protruding tube of said external valve base, said tapered loop edge corresponding to said oblique edge of said internal valve base.

4. The pneumatic tool of claim 3, further comprising:

an outlet nozzle placed on an external end of said external valve base.

5. The pneumatic tool of claim 3, wherein said first cylinder and said second cylinder are formed into one-piece therein.

* * * * *